United States Patent [19]

Miyabe

[11] 4,086,574

[45] Apr. 25, 1978

[54] FIRE DETECTION SYSTEM

[75] Inventor: Atsushi Miyabe, Yokohama, Japan

[73] Assignee: Hochiki Corporation, Japan

[21] Appl. No.: 707,608

[22] Filed: Jul. 22, 1976

[30] Foreign Application Priority Data

Jul. 25, 1975 Japan ..... 50-90057

[51] Int. Cl.[2] ..... G08B 17/00

[52] U.S. Cl. ..... 340/227 R; 340/228 R

[58] Field of Search ..... 340/227 R, 227.1, 228.1, 340/228 R

[56] References Cited

U.S. PATENT DOCUMENTS 3,621,262 11/1971 Lecuyer ..... 340/228 R

*Primary Examiner*—Glen R. Swann, III

*Attorney, Agent, or Firm*—Wenderoth, Lind & Ponack

[57] ABSTRACT

The present invention is a fire detection system. A timer sets an observation time. This may be accomplished by a first counter or shift register receiving a predetermined number of oscillator pulses. A second counter or shift register counts an alarm pulse produced by an AND circuit from the oscillator and the output of a fire detector. If the observation time expires before the second counter or shift register reaches its full count, the second counter or shift register is reset. If the second counter or shift register reaches its full count prior to the expiration of the observation time, the fire alarm is activated. Using this method, the system distinguishes a false alarm from the fire detector from the actual start of a fire.

4 Claims, 12 Drawing Figures

FIG.5
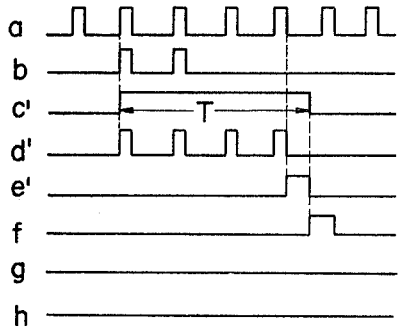
FIG.6a
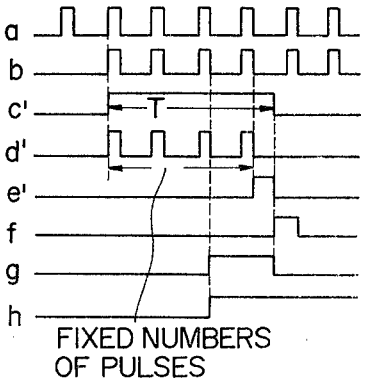
FIG.7
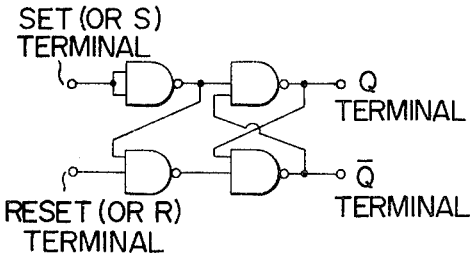
FIG.8
| S | R | Qn | $\bar{Q}$n |
|---|---|---|---|
| L | L | Qn-1 | $\bar{Q}$n-1 |
| H | L | H | L |
| L | H | L | H |
| H | H | H | L |

FIRE DETECTION SYSTEM

BACKGROUND OF THE INVENTION

1. Field of the Invention

The present invention is a fire detection system that distinguishes a false alarm from a real alarm by requiring a predetermined number of alarm signals from the fire sensor during an observation period.

2. Prior Art

A fire warning system is disclosed in U.S. Pat. No. 3,842,409, in which the output of a fire sensor is converted into successive pulses activating a shift register to supply an output. It uses a capacitor independently repeating its charging and discharging cycle to supply the input to the data terminal of the shift register. After the output of the fire sensor blocks the line for discharging the capacitor, the voltage across the capacitor continues unchanged at the data terminal. The shift register shifts this signal supply to supply its output by receiving clock pulses. However, it does not distinguish the start of a fire from causes other than a fire, even if the fire sensor sends a continuous output signal.

SUMMARY OF THE INVENTION

An object of the present invention is to provide a fire detection system that can distinguish the output of a fire sensor due to the start of a fire from causes other than a fire, by way of a means for limiting and repeating a detection observation time and a means for counting pulses obtained from a fire sensor.

Another object of the present invention is to provide a fire detection system using a counting means such as a counter or a shift register for controlling the detection observation time and also another counting means such as a counter or a shift register for counting pulses obtained from the fire sensor.

Still another object of the present invention is to provide a fire detection system using a common oscillator to activate both the counting means for controlling the detection observation time and the means for counting pulses obtained from the fire sensor, in which the pulse counting means counts such detection pulses as supplied from an AND gate receiving the clock pulse from the oscillator and also the output supplied from the sensor so as to distinguish the output due to the start of a fire from causes other than a fire in accordance with a predetermined relation between the number N1 of pulses equivalent to the detection observation time and another number N2 of the above detection pulses given to the counting means.

It is important, in the field, to distinguish any output supplied from the fire sensor due to the actual start of a fire from that due to causes other than a fire, because most phenomena accompanying the start of a fire are similar to that brought about by causes other than a fire, such as smoke produced by a fire or from the smoking of cigarettes, water molecules produced by a fire or from boiling water, heat from a fire or the ordinary use of heaters or heating apparatus and so on. According to a statistical analysis shown in FIG. 9, such an important distinction may be made by using the length of the detection observation time with a set of pulses in a suitable number to be counted within the predetermined detection observation time. For instance, case I shows a fire sensor supplying an output by virtue of high frequency electro-magnetic interference; another similar output was measured when induction of alternating current occurred near the sensor. Case II shows the output obtained when a strong air current struck the sensor from a window or an air-conditioning duct. A further case III shows the output due to suspensions in air near the sensor caused when a room was dusted to keep clear or when many persons smoked cigarettes. The last case IV shows the output of an actual fire. When a sampling pulse "*a*" converts the measurement output of the sensor into detection pulses, such detection pulses are obtained in smaller numbers than the number caused by a fire because the causes other than fire exist for a short time relative to the duration of a fire; or do not produce permanent physical change thereof. Thus, if the counting of such detection pulses is limited to a predetermined detection observation time, the output of the fire sensor due to a fire may be distinguished from causes other than a fire.

BRIEF EXPLANATION OF DRAWINGS

FIGS. 5 and 6*a* are time charts for distinguishing causes other than a fire from a fire;

FIG. 7 is a latch circuit used in the circuit of the FIG. 4*a*,

FIG. 8 is a truth table relating to the latch circuit of the FIG. 7,

DETAILED DESCRIPTION OF THE INVENTION

Figure 1:
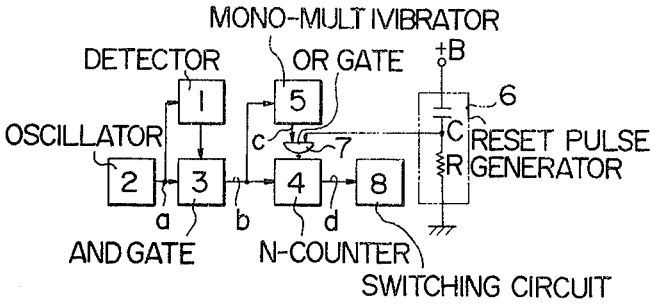
FIG. 1 is a block diagram of a fire detection system according to the present invention.
Figure 2:
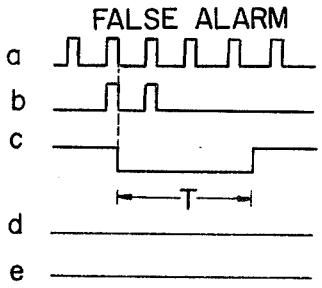
FIGS. 2 and 3 are time charts for distinguishing causes other than a fire from a fire.
Figure 3:
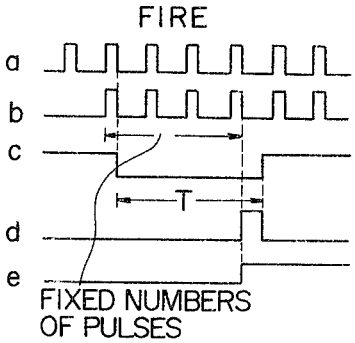

Referring to FIG. 1, a detector 1 supplies an electrical output therefrom when the value of a physical variable reaches a predetermined level for issuing a fire alarm, for instance, a predetermined level of smoke or other combustion substances produced from a fire. The measuring means is an ionization chamber sensor, a photo-electrical sensor, a gas detector or the like in the prior art. An oscillator 2 supplies therefrom pulses "*a*" as in FIGS. 2, 3, 5, 6*a*, 6*b* and 9. An AND gate 3 receives the pulse "*a*" from the oscillator 2 and also the output from the detector 1 responding to its predetermined value of physical variable and supplies therefrom a detection output "*b*" when the both inputs are present. This detection output "*b*" which has the same characteristics of the pulse "*a*" enters an N-coded counter 4 (which requires N pulses to supply its output), and triggers a mono-multivibrator 5. This mono-multivibrator 5, which acts to set the observation cycle for repeating the counting action at the N-coded counter 4, sends a continuous output "*c*" during the observing cycle as shown in FIGS. 2 and 3, thereby to reset the N-coded counter 4 every time the observing cycle ends. The function of the mono-multivibrator 5 thus limits and maintains the time T of the detection observation within which the detector 1 must supply the detection pulses "b" through the AND gate 3 in response to the predetermined value of physical variable in order to issue a fire alarm.

The detection observation time T is, for instance, from 5 sec. to 30 sec. according to a statistical result, when pulse "a" has a pulse interval of from 1 sec. to 10 sec. The start of a fire or cause other than a fire is reliably distinguished by using the data of the desirable number of the detection pulses "b" and the detection observation time T. For example, suppose the pulse interval of the pulse "a" is 2 sec., and that four pulses are required to supply an output from the N-coded counter 4. The detection observation time T is subsequently about 7 sec. so as to reset the N-coded counter 4 after the latter sends out an output "d," if four successive pulses are counted. When the N-coded counter 4 counts three successive pulses after receiving the first pulse, the output "d" is supplied therefrom after 6 sec. of the counting time elapses from the first pulse. The mono-multivibrator 5 stops supplying the continuous output "c" to the N-coded counter 4 later about 1 sec. after the output "d" has been supplied from the N-coded counter 4, so that the output "d" is shaped as a pulse as shown in FIG. 3. The output "d" thus pulse-shaped activates a switching circuit 8 to issue a fire alarm. The condition for issuing the fire alarm in this example is a count four successive pulses "b" having the pulse interval of 2 sec. within the 7 sec. of the detection observation time T(FIG. 3).

A reset pulse generator 6 is used to generate a reset pulse of a H(= 1) level when the power supply is turned on. This circuit comprises an input terminal +B, a capacitor C and a resistor R. This reset pulse is lead to an OR gate 7 whose output connects with the N-coded counter 4 to reset the same. The output "c" of the mono-multivibrator 5 is also lead to the OR gate 7.

In event the number of successive pulses "b" which are supplied from the AND gate 3 within the detection observation time T is smaller than the predetermined number, the N-coded counter 4 does not produce an output and is thereafter reset to recover its starting state by the end of the output "c" of the mono-multivibrator 5. Thus, any cause which may make the fire sensor output a detection pulse or pulses is satisfactorily distinguished from an actual fire because the former produces a number of pulses that are always smaller than the predetermined number for signaling a fire (FIG. 2).

In the event that detector 1 supplies successive pulses "b" in response to the value of its measured physical variable being above its predetermined level for any reason, the N-coded counter 4 produces the output "d" because the inputting pulses enter the N-coded counter 4 in the required number within the detection observation time T given by the mono-vibrator 5. This is reliably distinguished as a fire according to the predetermined number of successive pulses "b." The output "d" thus produced is shaped as a pulse as shown by "d" of FIG. 3 when the voltage supply "c" of the mono-multivibrator 5 resets the N-coded counter 4 soon after the time T elapses. The switching circuit 8 produces its output "e" to issue a fire alarm as the output "d" applies thereto.

Figure 4A:
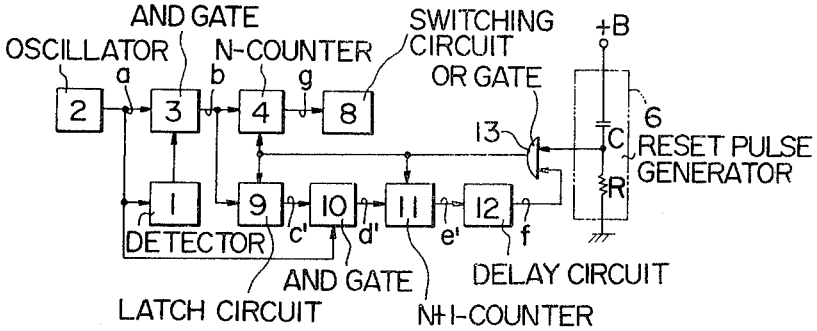
FIG. 4*a* is another block diagram according to the present invention.

A fire detection system shown in the FIG. 4a uses an N+1-coded counter 11 in place of the mono-multivibrator 5, for the purpose of providing the detection observation time T. An AND gate 10 receives the pulse "a" of the oscillator 2 and also an output "c'" of a latch circuit 9. Another pulse "d'" similar to the pulse "a" is supplied from the AND gate 10 to the N+1-coded counter 11, so that the counting repeats correctly at the N+1-coded counter 11. This latch circuit 9 becomes conductive by the input of the first pulse of the successive pulses "b" from the AND gate 3, while this first pulse enters to the N-coded counter 4 at the same time. Accordingly, the detection observation time T at this system is to start when a first detection pulse "b" enters to the latch circuit 9 so as to end when the latch circuit 9 is reset by a reset output generated from the N+1-coded counter 11 in response to receiving the number N+1 clock pulses.

When the N-coded counter 4 receives the detection pulses "b" in the predetermined number within the detection observation time T, an output "g" thereof applies to the switching circuit 8, thereby supplying an output "h" therefrom for operating a fire warning apparatus associated with this switching circuit. The reset pulse "e'" which is supplied from the N+1-coded counter 11 is converted into a delayed pulse "f" through a delay circuit 12, and then the delayed pulse "f" resets the N+1-coded counter 11, the N-coded counter 4 and also the latch circuit 9. Delay circuit 12 produces delayed output "f" long enough to reset both counters 11 and 4 and also the latch circuit 9.

Since the detector 1 produces pulses "b" in a smaller number than the predetermined number N due to any cause other than a fire, the N-coded counter 4 does not supply its output "g" in FIG. 5. The continuing and increasing physical changes caused by a fire cause the detector 1 to produce pulses "b" in a number greater than or equal to the predetermined number N, and the N-coded counter 4 supplies an output "g" thereby to issue a fire alarm (FIG. 6a). A real distinction between a fire and a cause other than a fire is reliably carried out at the fire detection system by requiring pulse "b" to be repeated through the time T before enabling the alarm.

The latch circuit 9 and its operable condition are shown in FIGS. 7 and 8. This circuit has a set terminal SET or S, a reset terminal RESET or R and a pair of output terminals Q and $\bar{Q}$. A truth table of the FIG. 8 shows its operable condition such that inputs of H=1 at S and L=0 at R generates H=1 at Q; inputs of L=0 at S and H=1 at R generates L=0 at Q. For the case of inputs L=0 at S and L=0 at R, Q and Q are not forced to assume any particular state but rather remain unchanged. The output terminal $\bar{Q}$ is not used in this system.

If reset pulse generator 6 is modified to interchange the positions of the capacitor C and the resistor R, a reset pulse is produced as an L(=0) level. The use of a H level or an L level may be selected corresponding to characteristics of the counter used there.

Figure 4B:
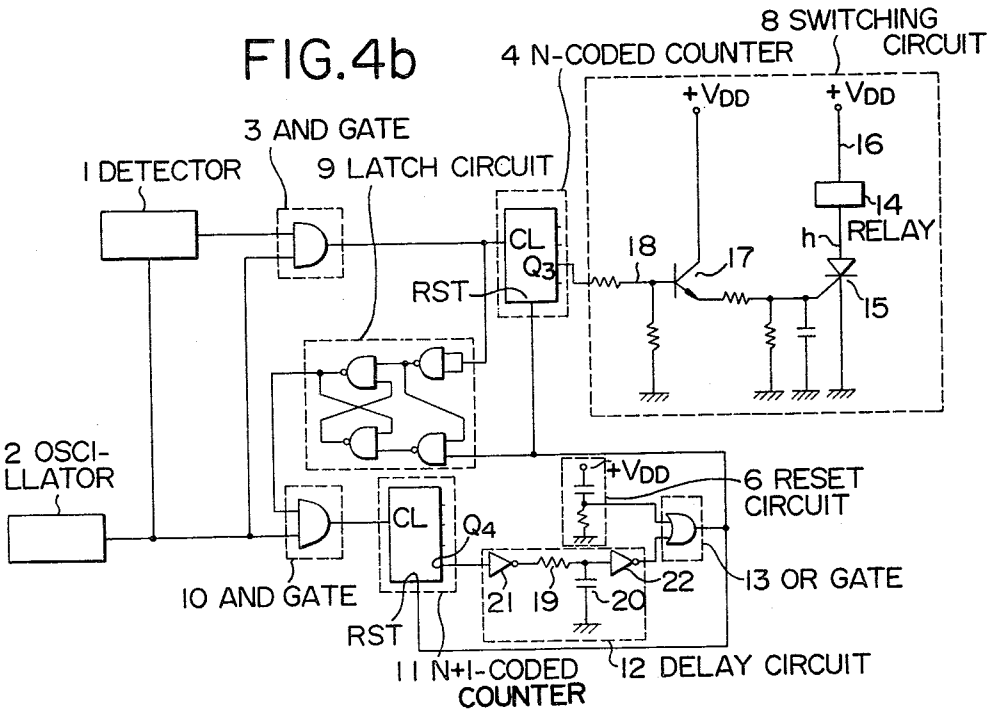
FIG. 4*b* is a circuit of the block diagram shown in the FIG. 4*a*.

In FIG. 4b, showing a circuit designed from the block diagram circuit of FIG. 4a, the switching circuit 8 comprises a relay line 16 having a relay 14 and a thyristor 15, and also a trigger line 18 having a transistor 17 for triggering th thyristor 15. The N-coded counter 4 connects at the output end Q3 with the trigger line 18. Between the output end Q4 of the N+1-coded counter 11 and the reset terminal RST of the N-coded counter 4 is the delay circuit 12 comprising a pair of inverters 21 and 22 including a resistor 19 and a capacitor 20 therebetween.

When the fire detection system is used to observe a special area that produces no heat, for instance, a safe room and so on, it is preferable to make the difference between the pulse numbers required by the respective N or N+1-coded counter greater. As an example, 10 clock pulses "*a*" of very short pulse interval could be alloted to the N+1-coded counter 11 to limit the detection observation time T; and three pulses could be alloted to the N-coded counter 4 to supply the output "*g*" for issuing a fire alarm. Thus by counting three pulses during the detection observation time, the detection pulses "*b*" which are supplied from the AND gate 3 could be successive or non-successive. After the N-coded counter 4 counts three pulses within the above time T, the output "*g*" may be supplied therefrom to issue a fire alarm. Since the physical variables change continually during the initial stage of a fire, a successive or non-successive detection of pulses "*b*" is used to distinguish the start of a fire from a cause other than a fire in such a special area in the manner of whether three pulses are counted within the above time T. This system is generally useful to detect the initial stage of a fire.

Figure 4C:
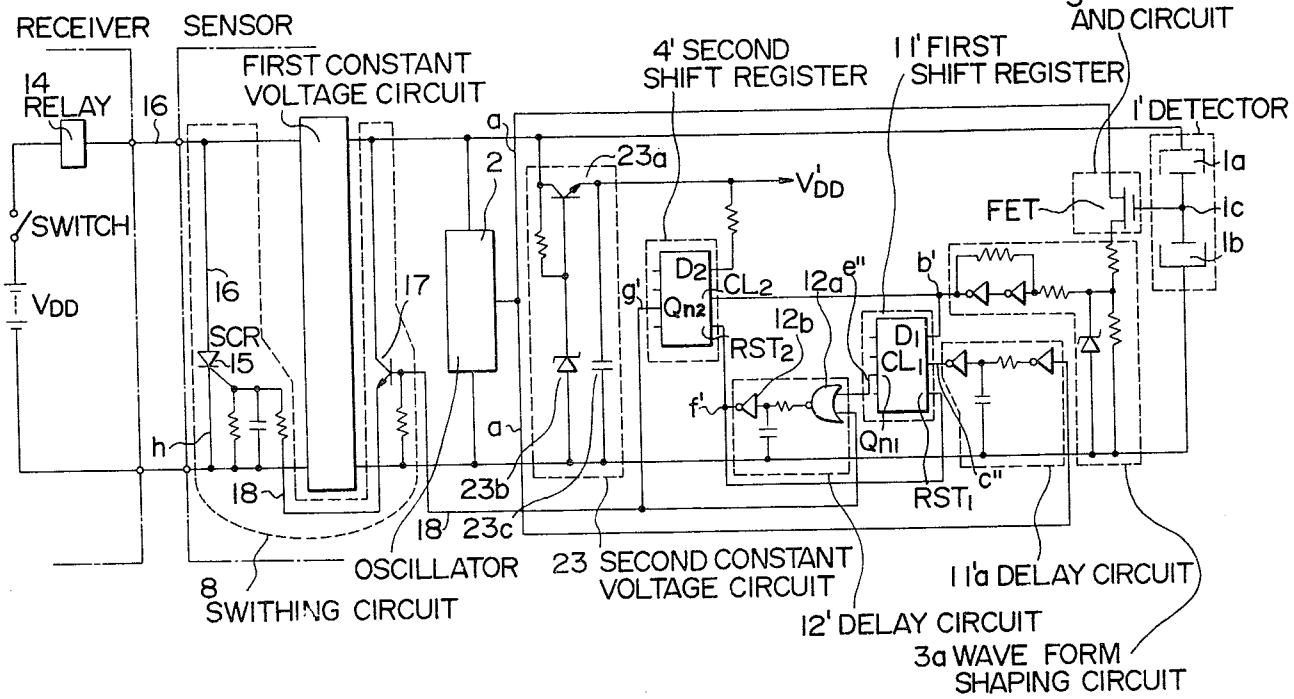
FIG. 4*c* is a circuit of another embodiment according to the present invention.

In FIG. 4*c*, a circuit uses a first shift register 11' for controlling the detection observation time T and also a second shift register 4' for counting the detection pulses in the predetermined number. An ionization chamber smoke sensor 1' is used as a smoke detection apparatus, which comprises an outer ionization chamber 1*a* and an inner ionization chamber 1*b* (or a single ionization chamber type sensor may be used). This sensor 1' is usually energized with d.c. power not alternating power.

A field effect transistor FET whose gate is connected to the intermediate electrode 1*c* of the sensor 1' acts as an AND circuit 3' in place of the usual AND gate element 3. As the output of an ionization chamber or a photo-electric transistor used as a photo-electric fire sensor is usually very weak, and must be amplified with a very high gain, any electric noise which is caused by induction of alternating current or high frequency electromagnetic interference is concurrently amplified, so that a false alarm is likely to issue responding to such an amplified noise. But the AND gate circuit 3' using the field effect transistor FET is very useful in removing the affect of any electric noise. The clock pulse "*a*" of the oscillator 2 enters at the FET and also the first shift register 11'. When the voltage appearing at the gate of the FET indicating a predetermined value of the physical variable at the ionization chamber coincides with the clock pulse "*a*," this FET supplies the detection pulse or pulses "*b'*."

This detection pulse or pulses "*b'''*" enters the clock terminal CL2 of the second shift register 4' through a wave-form shaping circuit 3*a* (comprising a pair of inverters), and also enters at the data terminal D1 of the first shift register 11'. On the other hand, the clock pulse "*a*" is successively entered into the clock terminal CL1 of the first shift register 11' through an auxiliary delay circuit 11'*a* which has a pair of inverters including a resistor and a capacitor therebetween.

The detection observation time T begins when the first detection pulse "*b'''*" which is supplied from the AND gate 3' enters the data terminal D1 of the first shift register 11'. This observation time predetermined number N1 of T is controlled by the clock pulses which the first shift register 11' requires to enable its output. The detection pulse or pulses "*b'''*" which may be supplied from the AND gate 3' within the detection observation time T will enter the clock terminal CL2 of the second shift register 4', so that the data shifts to the next position. This data to the second shift register 4' is always applied to the data terminal D2 from an output $V_{DD}'$ of the second constant voltage circuit 23.

The second shift register 4' supplies its output "*g'''*" from the output end $Q_{N2}$ when it receives the number N2 or more detection pulses "*b'''*" within the period of the clock pulse number N1 for repeating the detection observation cycle. If the shift register 4' does not input detection pulses in the predetermined number N2, this register is reset by an output supplied from the output end $Q_{N1}$ of the first shift register 11' after the detection observation time T elaspes. That is, after a delay circuit 12' which has an OR gate 12*a* and an inverter 12*b* including a resistor and a capacitor therebetween delays the output "*e''''*" of the output end $Q_{N1}$ to produce a reset pulse "*f*," this reset pulse "*f*" enters at the reset terminal RST2 and clears the shift register 4'.

When the second shift register 4' receives detection pulses "*b'''*" in the predetermined number N2, the output "*g'''*" thereof is supplied which not only enters a transistor 17 but turns on the OR gate 12*a* of the delay circuit 12' so as to reset itself after the delay of delay circuit 12'. This delay circuit 12' is especially effective to reset both the first and second shift registers 11' and 4' due to the delay time. On the other hand, the transistor 17 after receiving the output "*g'''*" through the line 18 triggers the thyristor 15, thereby to activate a relay 14.

This circuit uses the second constant voltage circuit 23 comprising a transistor 23*a*, zener diode 23*b* and a capacitor 23*c*, thereby to produce the power source $V_{DD}'$ suitable for the C-MOS used herein. This voltage $V_{DD}'$ is lower than the voltage $V_{DD}$ of the primary power source, so that the switching action of the respective C-MOS may be made faster. Power wiring to all the C-MOS elements is not shown.

Figure 6B:
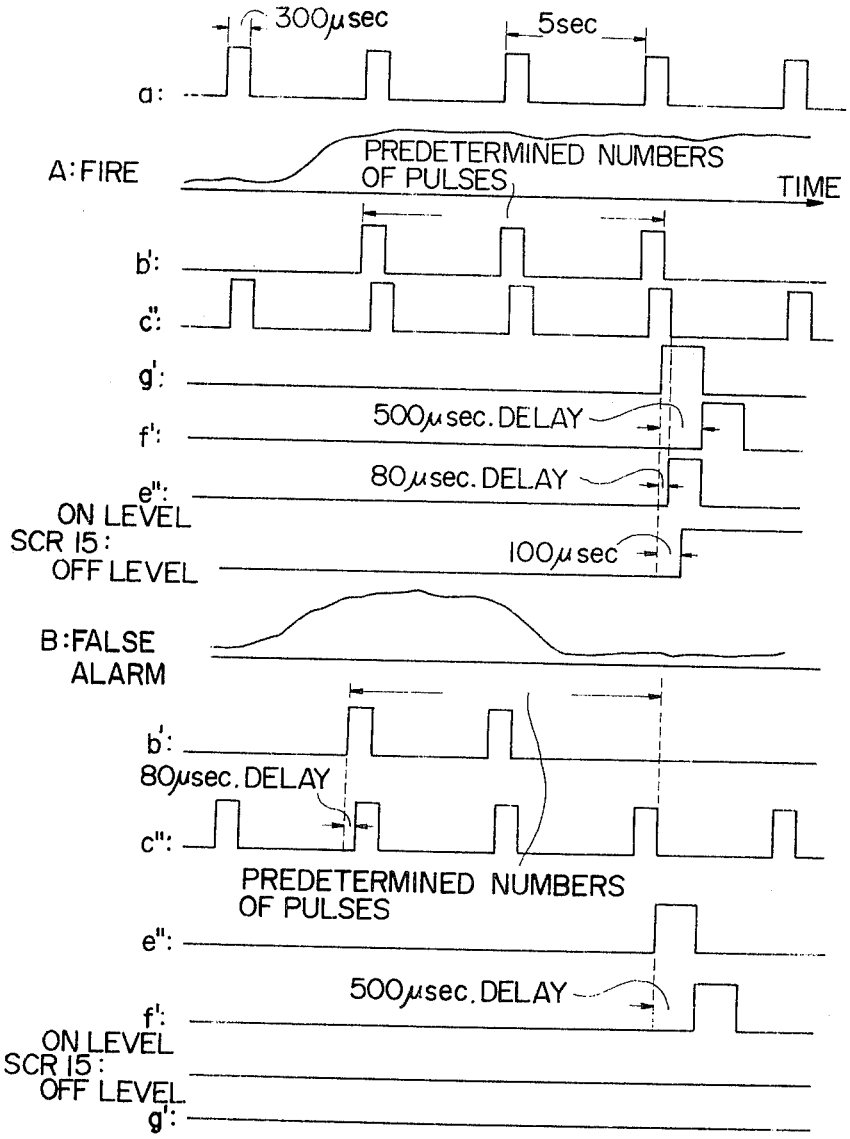
FIG. 6*b* is a time chart of the system shown in the FIG. 4*c*.
Figure 9:
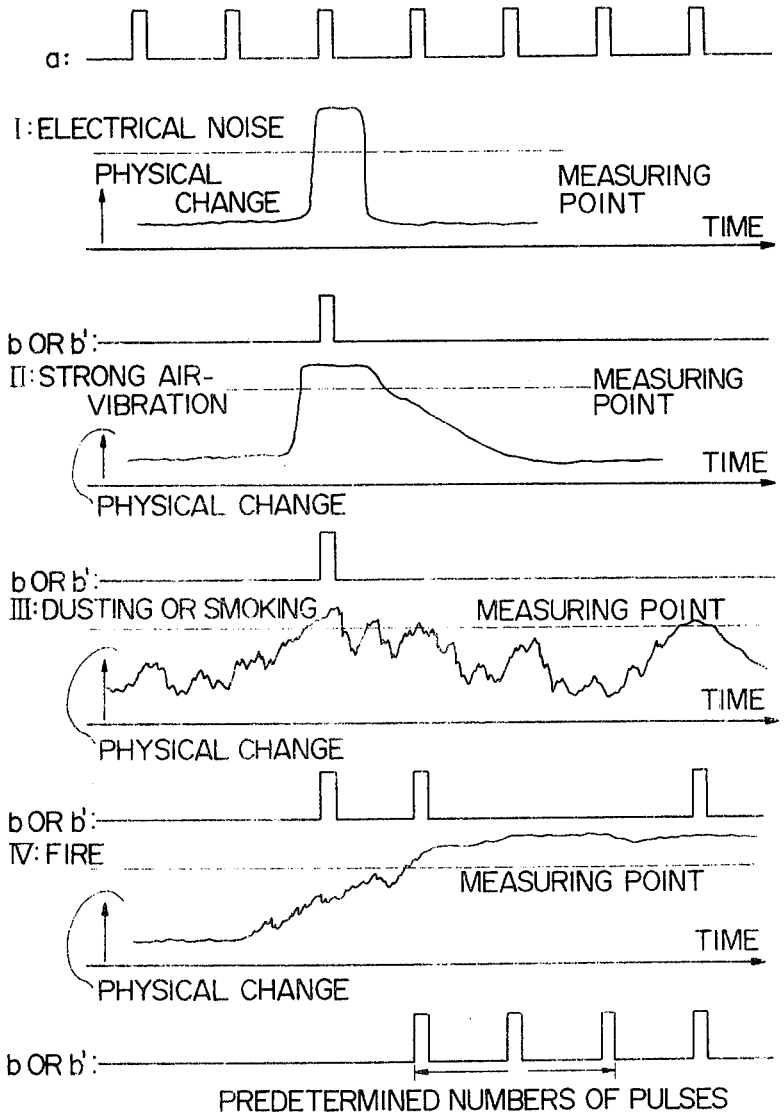
FIG. 9 shows a statistic pattern relating to between the detection pulse and kind of cause supplying the detection pulse.

FIG. 6*b* shows a time chart relating to the circuit of FIG. 4*c*; it provides that, for instance, the clock pulse "*a*" of the oscillator 2 has a 300 micro sec. pulse length and also a 5 sec. pulse interval. In event A, a fire arises and continuously causes physical changes especially represented by smoke soon thereafter, the AND gate 3' supplies successively the detection pulses "*b'''*" in the predetermined number N2 (successive three detection pulses in the chart), as the detector 1 continuously measures the physical variable above the predetermined level suitable for issuing a fire alarm. On the other hand, as the clock pulses "*a*" are made the delayed pulses "*c''''*", with the delay time (80 micro sec.) relative to the detection pulses "*b'''*", are produced by virtue of the auxiliary delay circuit 11'*a*. The detection pulses "*b'''*" not only enter the data terminal D1 of the first shift register 11', but enter the clock terminal CL2 of the second shift register 4', so that the data at the data terminal D2 is successively shifted to supply an output "*g'''*" from the output end $Q_{N2}$ thereof. On the other hand, the delayed pulses "*c''''*" causes the output "*e''''*" from the output end $Q_{N1}$ of the first shift register 11', and then this output "*e''''*" is converted into the delayed output "*f*" with the delay time (500 micro sec.), so that the output "*g'''*" of the second shift register 4' and also the output "*e''''*" of the first shift register 11' are reset by the delayed output *f*." The length of the output "*g'''*" is same as the delay time (500 micro sec.). The pulse output "*g'''*" having 500 micro sec. length subsequently triggers the thyristor 15 after amplification by the transistor 17. The input time of 100 micro sec. which is usually required to trigger the thyristor is reliably satisfied with the pulse length of 500 micro sec.

In event B, suspension in the air casually increases but decreases soon thereafter, for instance, due to the dusting of a room or the smoking of a cigarette. Such causes are not due to a fire, the AND gate 3' does not supply the detection pulse "*b'''*" reaching the predetermined number N2 (two pulses being less than the three pulses fixed here), so that the second shift register 4' supplies no output "*g'*." On the other hand, the clock pulses "*c''''*" delayed relative to the detection pulses "*b'''*" (with a delay time of 80 micro sec.) enter the first shift register 11', thereby enable the output "*e''''*" therefrom after the detection observation time T (10 sec.) elapses, and this output is converted into the delayed output "*f'*" (the delayed time of 500 micro sec.), so that the delayed output "*f'*" stops subsequently the output "*e''''*" and at the same time clears the second shift register 4'. Accordingly, the thyristor 15 remains in a non-conductive stage, and a fire alarm is not issued.

What is claimed is:

1. A fire detecting system comprising:

a fire-detection means for production of an output upon detection of a fire;

an oscillator means for supplying a series of oscillator pulse signals;

an AND circuit means having a first input connected to said fire-detection means and a second input connected to said oscillator for producing an alarm pulse when both of said fire-detection means output and said oscillator pulse signal are present;

a counting means having an input connected to said AND circuit means, for receiving said alarm pulses and producing an output after receiving a predetermined number of said alarm pulses;

an observation time control means responsive to said oscillator means and coupled to said counting means for generating an observation time of predetermined length starting upon generation of an oscillator pulse by said oscillator means and resetting said counting means at the end of said observation time; and a fire warning means connected to said counting means for generating fire warning upon receipt of the output from said counting means.

2. A fire detection system as claimed in claim 1 in which:

said observation time control means is connected to said AND circuit means and said counting means for generating an observation time of predetermined length starting upon receipt of an alarm pulse from said AND circuit means and resetting said counting means at the end of said observation time.

3. A fire detection system as claimed in claim 1 in which said observation time control means comprises:

a latch circuit connected to said AND circuit means for production of a continuous latch signal upon receiving an alarm pulse from said AND circuit means until reset;

a second AND circuit means connected to said latch circuit and said oscillator for producing output pulse when both of said latch signal and oscillator pulse signal are present;

a second counting means connected to said second AND circuit means, for receiving the output pulses of said second AND circuit means and producing an output after receiving a predetermined number of said output pulses; and a delay means connected to said second counting means for resetting said counting means, said second counting means and said latch circuit a predetermined time after receiving the output of said second counting means.

4. A fire detection system as claimed in claim 1, in which said observation time control means comprises:

an oscillator delay means connected to said oscillator for delaying said oscillator pulse signals a predetermined amount;

a shift register means having a data input connected to said AND circuit means and a clock input connected to said oscillator delay means for entering the alarm pulses of said AND circuit means and shifting the data therein in response to said delayed oscillator pulse signals, whereby said shift register means produces an output after receiving an alarm pulse followed by a predetermined number of delayed oscillator pulses; and a reset delay means connected to said shift register means for resetting said counting means and said shift register means a predetermined time after receiving the output of said shift register means.

* * * * *